US006022129A

United States Patent [19]

Tang

[11] Patent Number: 6,022,129

[45] Date of Patent: Feb. 8, 2000

[54] HIGH INTENSITY LAMP DEVICE

[76] Inventor: Shih-Chuan Tang, 58, Ma Yuan West St., Taichung, Taiwan

[21] Appl. No.: 09/157,158

[22] Filed: Sep. 18, 1998

[51] Int. Cl.[7] ..... F21V 21/00

[52] U.S. Cl. ..... 362/404; 362/418; 362/147; 362/249

[58] Field of Search ..... 362/249, 250, 362/285, 226, 147, 404, 418

[56] References Cited

U.S. PATENT DOCUMENTS

| | | | |
|---|---|---|---|
| 4,319,314 | 3/1982 | Morton | 362/432 |
| 4,731,710 | 3/1988 | Distasio | 362/250 X |
| 4,747,025 | 5/1988 | Barton | 362/285 X |
| 5,455,754 | 10/1995 | Hoffner | 362/250 |
| 5,702,177 | 12/1997 | Lin | 362/226 |
| 5,833,358 | 11/1998 | Patik | 362/391 |

*Primary Examiner*—Laura K. Tso

[57] ABSTRACT

A high intensity lamp device has a lamp connected to a first connection rod, an outer threaded joint connected to the first connection rod and a tube-shaped seat, a hollow cylinder seat enclosing a first half coupler and a second half coupler, an upper end of the second connection rod inserted in the first half coupler and the second half coupler, a swivel cover having a cross-shaped center block and an inner thread, a disk inserted in the swivel cover, and a guide track inserted in the first half coupler and the second half coupler. The first half coupler has a first threaded upper portion. The second half coupler has a second threaded upper portion. The swivel cover covers the first threaded upper portion and the second threaded upper portion.

7 Claims, 7 Drawing Sheets

HIGH INTENSITY LAMP DEVICE

BACKGROUND OF THE INVENTION

The present invention relates to a high intensity lamp device. More particularly, the present invention relates to a high intensity lamp device which can be elongated or detached easily.

Referring to FIGS. 1 and 2, a conventional high intensity lamp device has a lamp support 1 disposed on a guide track 2. The guide track 2 has a channel 21. A hand lever 11 is disposed on the lamp support 1. The lamp support 1 has an insertion block (not shown in the figures) inserted in the channel 21. The hand lever 11 controls the motion of the insertion block. However, the conventional high intensity lamp device cannot be extended.

SUMMARY OF THE INVENTION

An object of the present invention is to provide a high intensity lamp device which can be detached easily.

Another object of the present invention is to provide a high intensity lamp device which can be elongated easily by adding connection rods.

Accordingly, a high intensity lamp device comprises a lamp, a tube-shaped seat, a first connection rod, an outer threaded joint, a second connection rod, a hollow cylinder seat, a first half coupler, a second half coupler coupling with the first half coupler, a disk, a swivel cover, and a guide track. The lamp is connected to the first connection rod. The outer threaded joint is connected to the first connection rod and the tube-shaped seat. The hollow cylinder seat encloses the first half coupler and the second half coupler. An upper end of the second connection rod is inserted in the first half coupler and the second half coupler. The swivel cover has a cross-shaped center block and an inner thread. The disk has a protruded bar. The disk is inserted in the swivel cover. The guide track is inserted in the first half coupler and the second half coupler. The first half coupler has a first threaded upper portion. The second half coupler has a second threaded upper portion. The swivel cover covers the first threaded upper portion of the first half coupler and the second threaded upper portion of the second half coupler.

DETAILED DESCRIPTION OF THE INVENTION

Figure 1:
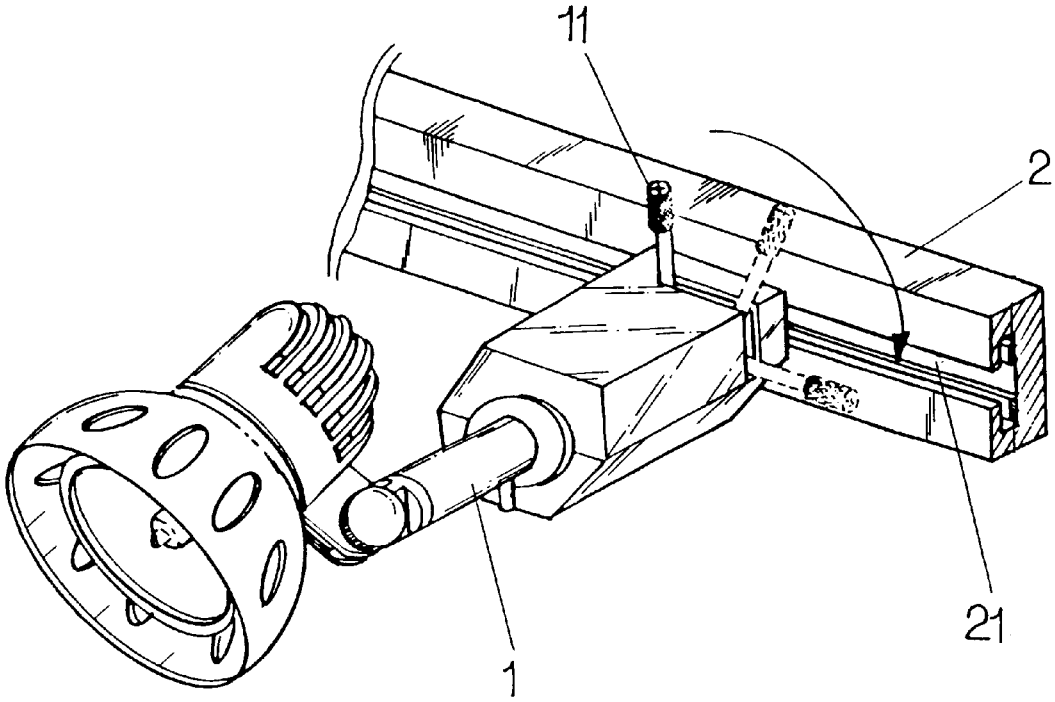
F I G. 1 PRIOR ART
FIG. 1 is a perspective view of a conventional high intensity lamp device of the prior art disposed on a guide track.
Figure 2:
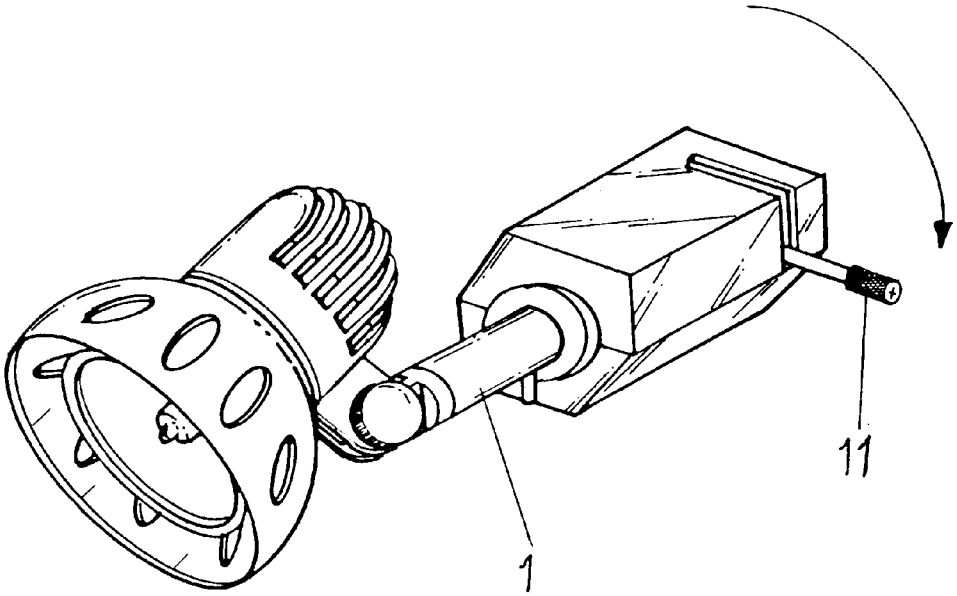
FIG. 2 PRIOR ART
FIG. 2 is a perspective view of a conventional high intensity lamp device of the prior art.
Figure 3:
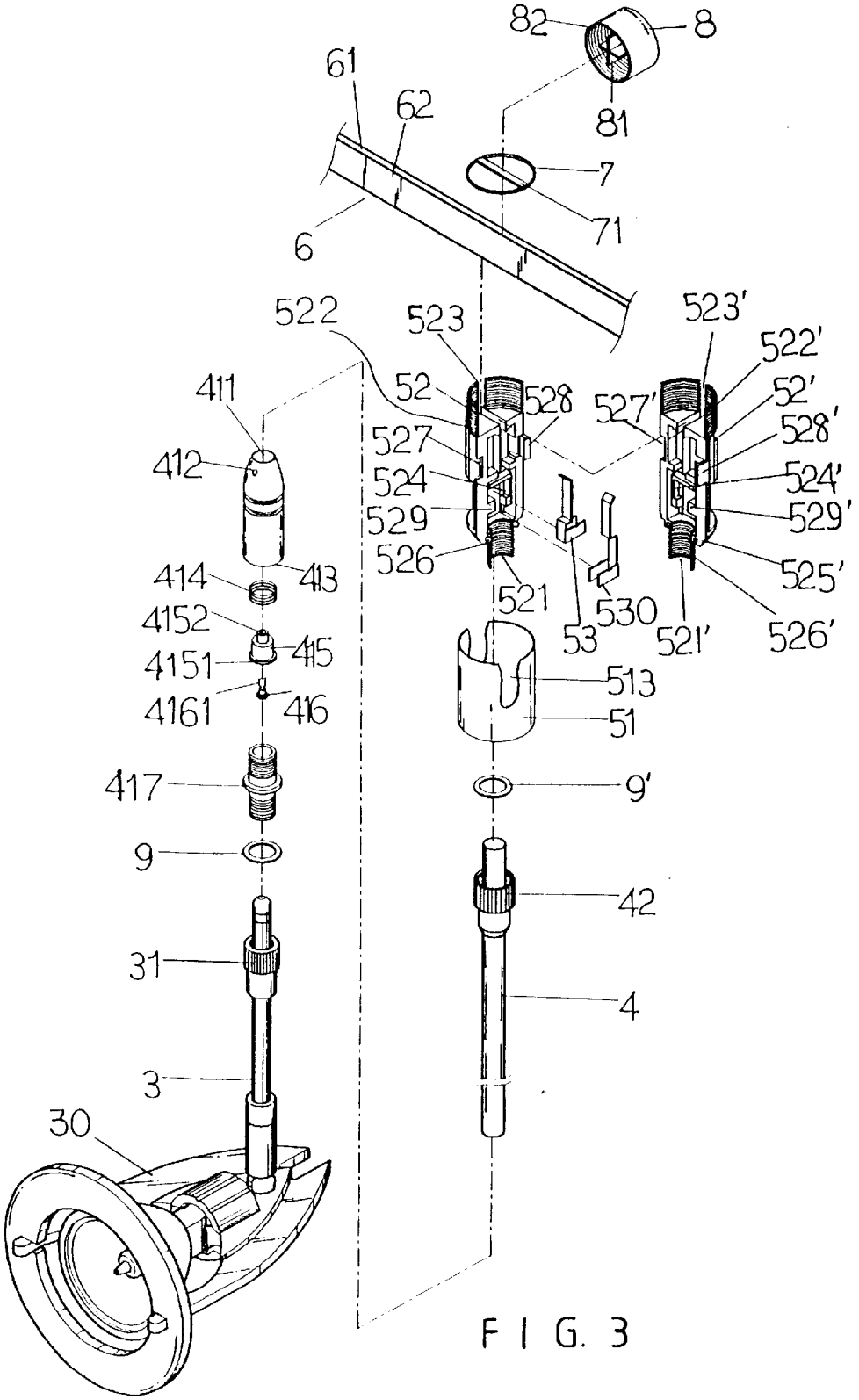
FIG. 3 is a perspective exploded view of a high intensity lamp device of a preferred embodiment in accordance with the present invention.
Figure 4:
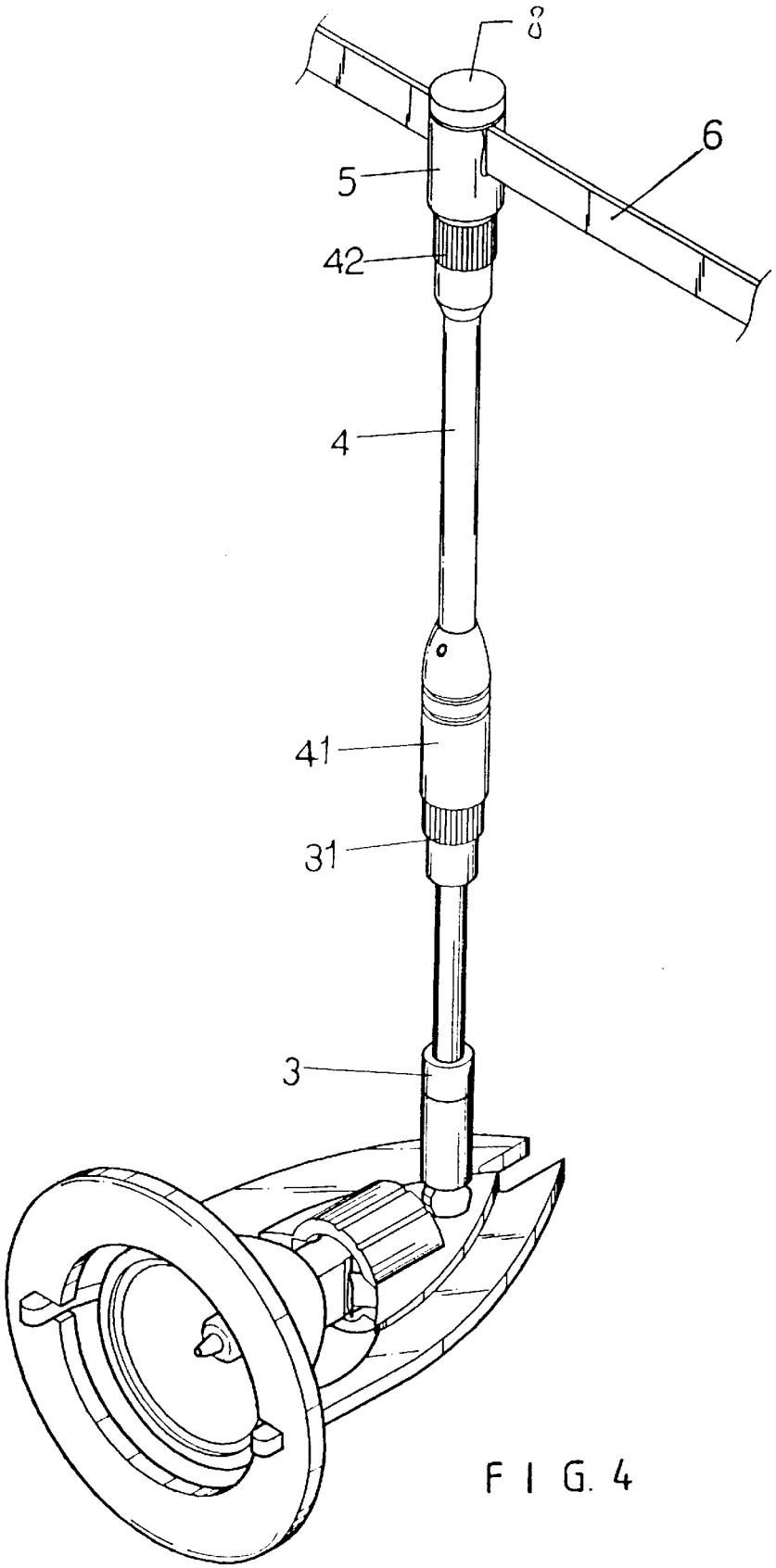
FIG. 4 is a perspective assembly view of a high intensity lamp device of a preferred embodiment in accordance with the present invention.
Figure 5:
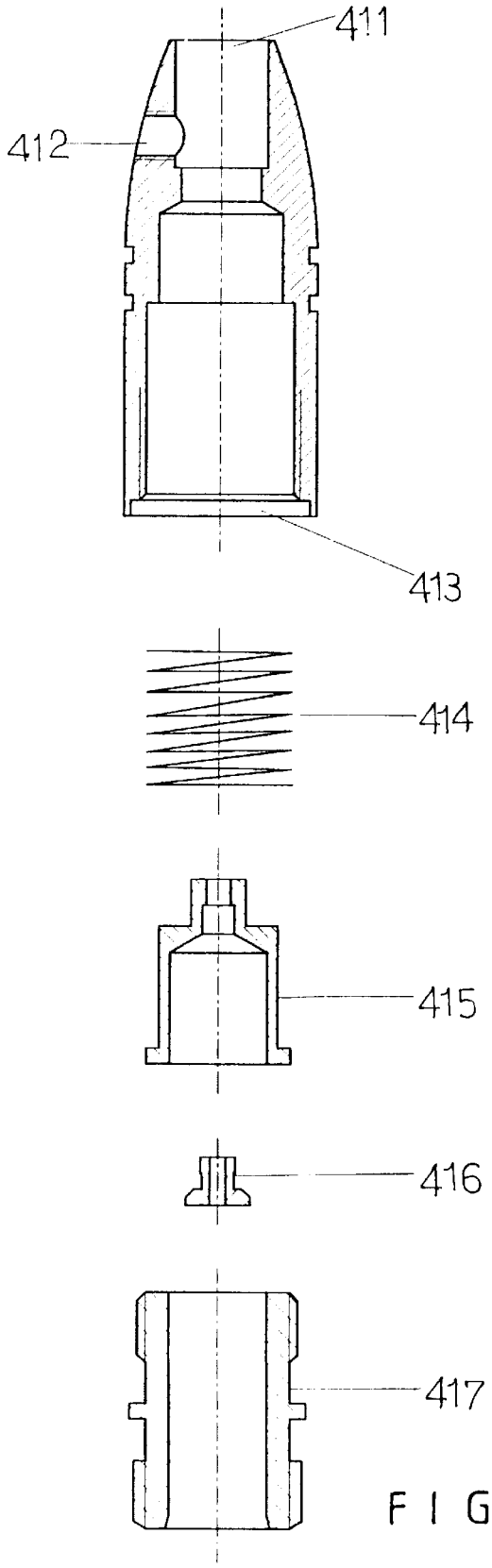
FIG. 5 is a sectional exploded view of a tube-shaped seat, a spring, a plastic plug, a wire support seat, and an outer threaded joint.
Figure 6:
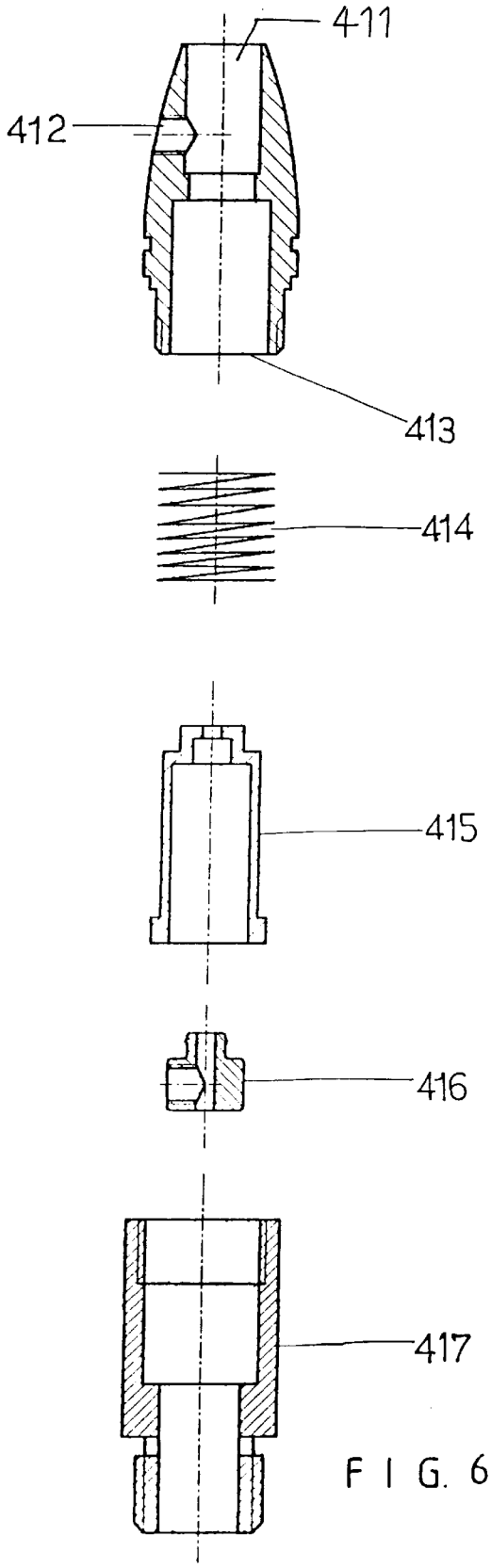
FIG. 6 is another sectional exploded view of a tube-shaped seat, a spring, a plastic plug, a wire support seat, and an outer threaded joint.
Figure 7:
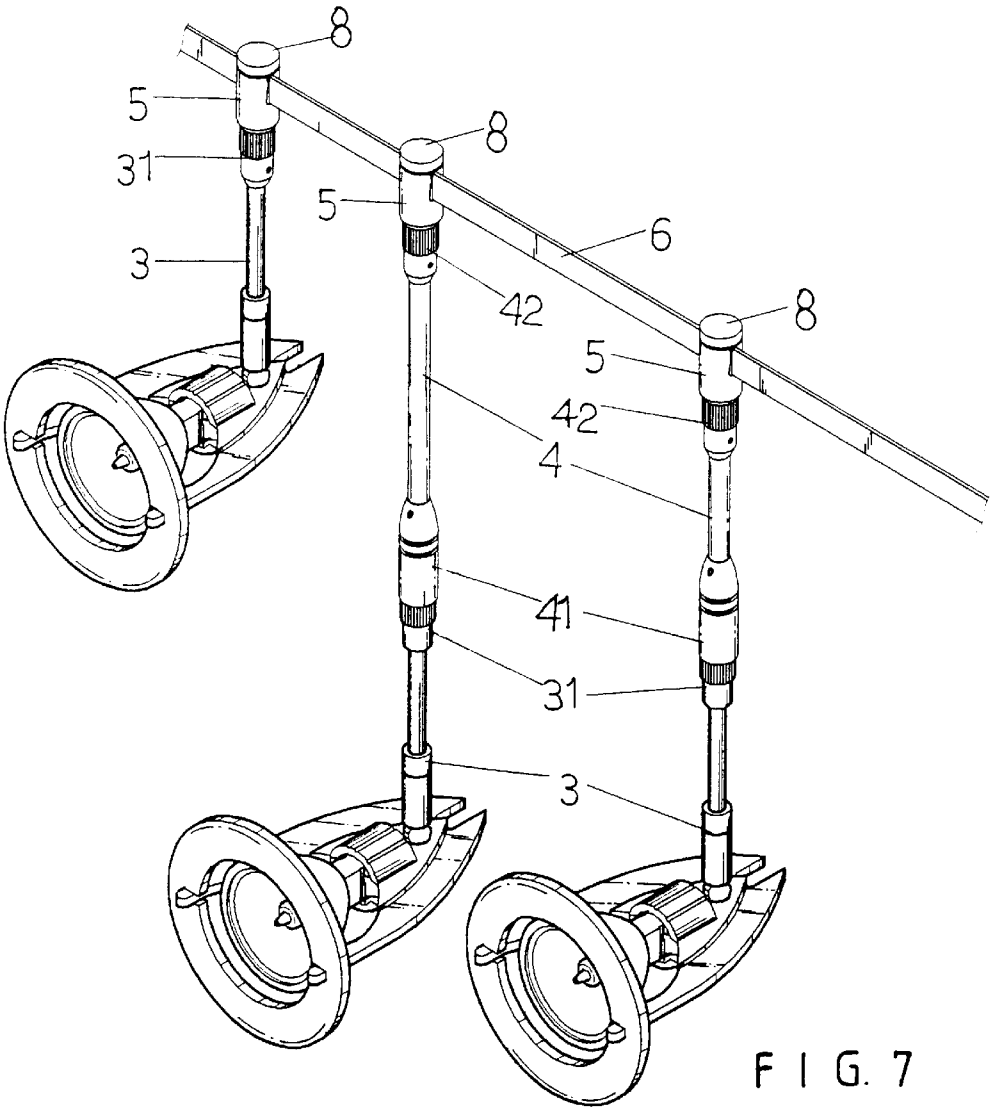
FIG. 7 is a schematic view illustrating an application of at least a high intensity lamp device of a preferred embodiment in accordance with the present invention.

Referring to FIGS. 3 to 7, a high intensity lamp device comprises a lamp 30, a tube-shaped seat 41, a first connection rod 3, an outer threaded joint 417, a second connection rod 4, a hollow cylinder seat 5, a first half coupler 52, a second half coupler 52' coupling with the first half coupler 52, a disk 7, a swivel cover 8, and a guide track 6.

The lamp 30 is connected to the first connection rod 3. The outer threaded joint 417 is connected to the first connection rod 3 and the tube-shaped seat 41. The hollow cylinder seat 5 encloses the first half coupler 52 and the second half coupler 52'. An upper end of the second connection rod 4 is inserted in the first half coupler 52 and the second half coupler 52'. The swivel cover 8 has a cross-shaped center block 81 and an inner thread 82. The disk 7 has a protruded bar 71. The disk 7 is inserted in the swivel cover 8. The guide track 6 is inserted in the first half coupler 52 and the second half coupler 52'. The first half coupler 52 has a first threaded upper portion 522. The second half coupler 52' has a second threaded upper portion 522'. The swivel cover 8 covers the first threaded upper portion 522 of the first half coupler 52 and the second threaded upper portion 522' of the second half coupler 52'.

The first connection rod 3 has a first inner threaded collar 31 engaging with the outer threaded joint 417. An upper portion of the first connection rod 3 passes through an annular pad 9.

The first half coupler 52 has a first threaded lower portion 521, a first click slot 523, a first block plate 524, a first recess 525, a first post 526, a first groove 527, a first protruded plate 528, and a first protrusion 529.

The second half coupler 52' has a second threaded lower portion 521', a second click slot 523', a second block plate 524', a second recess 525', a second post 526', a second groove 527', a second protruded plate 528', and a second protrusion 529'.

The first click slot 523 and the second click slot 523' receive the guide track 6.

The guide track 6 has a conductive plate 62 and an insulation rubber plate 61.

The second connection rod 4 has a second inner threaded collar 42 engaging with the first threaded lower portion 521 of the first half coupler 52 and the second threaded lower portion 521' of the second half coupler 52'. An upper portion of the second connection rod 4 passes through a washer 9'.

The tube-shaped seat 41 has a top round hole 411, a bottom threaded hole 413, and a threaded aperture 412. A spring 414, and a plastic plug 415 are inserted in the tube-shaped seat 41. The plastic plug 415 has a bottom hole 4151 and a top hole 4152. A wire support seat 416 is inserted in the top hole 4152. The wire support seat 416 receives two wires 4161.

A first elastic copper plate 53 and a second elastic copper plate 530 are inserted in the first half coupler 52 contacting the conductive plate 62.

The hollow cylinder seat 5 has a main body 51 and two notches 513 matching the respective first click slot 523 and the respective second click slot 523'.

Referring to FIG. 7 again, the second connection rod 4 can be detached from the high intensity lamp device easily.

The present invention is not limited to the above embodiment but various modification thereof may be made. Furthermore, various changes in form and detail may be made without departing from the scope of the present invention.

I claim:

1. A high intensity lamp device comprising:

a lamp, a tube-shaped seat, a first connection rod, an outer threaded joint, a second connection rod, a hollow cylinder seat, a first half coupler, a second half coupler, a disk, a swivel cover, and a guide track, the second half coupler coupling with the first half coupler, the lamp connected to the first connection rod, the outer threaded joint connected to the first connection rod and the tube-shaped seat, the hollow cylinder seat enclosing the first half coupler and the second half coupler, an upper end of the second connection rod inserted in the first half coupler and the second half coupler, the swivel cover having a cross-shaped center block and an inner thread, the disk having a protruded bar, the disk inserted in the swivel cover, the guide track inserted in the first half coupler and the second half coupler, the first half coupler having a first threaded upper portion, the second half coupler having a second threaded upper portion, the swivel cover covering the first threaded upper portion of the first half coupler and the second threaded upper portion of the second half coupler.

2. A high intensity lamp device as claimed in claim 1, wherein the first connection rod has a first inner threaded collar engaging with the outer threaded joint.

3. A high intensity lamp device as claimed in claim 1, wherein the first half coupler has a first threaded lower portion, the second half coupler has a second threaded lower portion, and the second connection rod having a second inner threaded collar engaging with the first threaded lower portion of the first half coupler and the second threaded lower portion of the second half coupler.

4. A high intensity lamp device as claimed in claim 1, wherein the first half coupler has a first click slot, the second half coupler has a second click slot, and the first click slot and the second click slot receive the guide track.

5. A high intensity lamp device as claimed in claim 1, wherein the guide track has a conductive plate and an insulation rubber plate.

6. A high intensity lamp device as claimed in claim 1, wherein the tube-shaped seat has a top round hole and a bottom threaded hole, and a spring, and a plastic plug are inserted in the tube-shaped seat, the plastic plug has a bottom hole and a top hole, a wire support seat is inserted in the top hole, and the wire support seat receives two wires.

7. A high intensity lamp device as claimed in claim 5, wherein a first elastic copper plate and a second elastic copper plate are inserted in the first half coupler contacting the conductive plate.

* * * * *